US009558615B2

(12) United States Patent
Maas et al.

(10) Patent No.: US 9,558,615 B2
(45) Date of Patent: Jan. 31, 2017

(54) INTERCHANGEABLE OVERLAY FOR AMUSEMENT DEVICES

(75) Inventors: Michael G. Maas, New Hope, PA (US); Jeffrey Kalis, Sparta, MI (US); Stephen Jarema, III, Pittsgrove, NJ (US)

(73) Assignee: AMI Entertainment Network, LLC, Wilmington, DE (US)

( * ) Notice: Subject to any disclaimer, the term of this patent is extended or adjusted under 35 U.S.C. 154(b) by 1051 days.

(21) Appl. No.: 13/315,526

(22) Filed: Dec. 9, 2011

(65) Prior Publication Data

US 2012/0146893 A1 Jun. 14, 2012

Related U.S. Application Data

(60) Provisional application No. 61/421,705, filed on Dec. 10, 2010, provisional application No. 61/447,354, filed on Feb. 28, 2011.

(51) Int. Cl.

| | |
|---|---|
| ***G09G 1/00*** | (2006.01) |
| ***G07F 17/32*** | (2006.01) |
| ***G07F 9/10*** | (2006.01) |

(52) U.S. Cl.

CPC ..... *G07F 17/3216* (2013.01); *G07F 9/10* (2013.01)

(58) Field of Classification Search

CPC ..... A63F 13/06; A63F 13/08; A63F 13/25; A63F 13/30; A63F 2300/30; A63F 2300/302; A63F 2300/308; H04M 1/72575; H04M 1/0283; H04M 2250/12; G07F 17/3216

USPC ..... D21/385; D14/133, 173, 496

See application file for complete search history.

(56) References Cited

U.S. PATENT DOCUMENTS

| | | | | |
|---|---|---|---|---|
| 6,779,904 | B1 * | 8/2004 | Van Dyk | 362/86 |
| 6,898,283 | B2 | 5/2005 | Wycherley et al. | |
| 7,305,260 | B2 | 12/2007 | Vuori et al. | |
| 7,555,320 | B2 | 6/2009 | Rydgren | |
| 7,628,501 | B2 * | 12/2009 | Obermeier et al. | 362/86 |
| 7,778,792 | B2 | 8/2010 | Huang et al. | |
| 7,907,119 | B2 | 3/2011 | Lin | |
| 2005/0026643 | A1 | 2/2005 | White et al. | |
| 2005/0139683 | A1 | 6/2005 | Yi | |
| 2005/0215325 | A1 * | 9/2005 | Nguyen | G07F 17/3202 463/46 |
| 2006/0052152 | A1 * | 3/2006 | Tedsen | G07F 17/3211 463/16 |
| 2007/0155511 | A1 * | 7/2007 | Grundstedt | G07F 17/32 463/46 |
| 2007/0287544 | A1 * | 12/2007 | Hirato | G07F 17/32 463/46 |
| 2011/0070948 | A1 * | 3/2011 | Bainbridge | G07F 17/3218 463/30 |
| 2011/0159924 | A1 | 6/2011 | Gonzalez et al. | |
| 2011/0281657 | A1 * | 11/2011 | McComb et al. | 463/46 |

FOREIGN PATENT DOCUMENTS

| | | | |
|---|---|---|---|
| EP | 1417775 | B1 | 1/2007 |
| WO | 2008035041 | A2 | 3/2008 |
| WO | 2008126391 | A1 | 10/2008 |

* cited by examiner

*Primary Examiner* — Michael Faragalla
(74) *Attorney, Agent, or Firm* — Panitch Schwarze Belisario & Nadel LLP

(57) ABSTRACT

An overlay for a nonportable amusement device is provided. The nonportable amusement device has a housing, a display, a memory and a controller. The overlay includes one or more panels selectively attachable to and removable from the housing of the nonportable amusement device.

18 Claims, 21 Drawing Sheets

INTERCHANGEABLE OVERLAY FOR AMUSEMENT DEVICES

CROSS-REFERENCE TO RELATED APPLICATIONS

This application claims the benefit of U.S. Provisional Patent Application No. 61/421,705, filed on Dec. 10, 2010, entitled "Interchangeable Overlay for Amusement Devices" and U.S. Provisional Patent Application No. 61/447,354, filed on Feb. 28, 2011, entitled "Interchangeable Overlay for Amusement Devices," the entire contents of which are incorporated by reference herein.

BACKGROUND OF THE INVENTION

An embodiment of the present invention relates generally to an overlay which is selectively attachable to and removable from an amusement device and, more particularly, which is selectively attachable to and removable from the housing or body of an amusement device.

Amusement devices having electronic games or songs for selection and play are generally well known in the art. Such amusement devices, such as game machines and jukeboxes, typically operate upon input of currency (i.e., coin, token, paper money, credit/debit cards or the like) and are installed in locations such as bars, restaurants, airports, shopping malls, video arcades, casinos, or the like. For game machines, the game choices may include card games, sports games, games of skill, games of chance, action games, trivia games and the like. For jukeboxes, a plurality of songs are generally available for selection and play. Recently, jukeboxes have become computerized, capable of playing selections of music as MP3 files, streaming audio data sets, or the like.

Many times, such amusement devices reflect a theme or image which the owner of the amusement device or the owner of the location where the amusement device is installed desires to portray. For example, an owner/operator of a 1950's style diner may provide a jukebox in the diner which has a "retro" appearance. However, when an amusement device owner/operator desires to change or upgrade the amusement device, the owner/operator must incur significant expenses as a completely new amusement device of the newly desired theme or appearance must be purchased.

It is therefore desirable to create an overlay for an amusement device that can be selectively attached to and removed from the housing or body of an amusement device. It is also desirable to have an overlay for an amusement device, such that the attachment of a particular overlay to the housing of an amusement device triggers the amusement device to alter the images and graphics of the user interface to conform with the default settings of the newly attached overlay. It is also desirable to create an overlay for an amusement device that can be selectively attached to and removed from the housing of the amusement device, wherein the overlay is programmed to present a variety of images, graphics and colors.

BRIEF SUMMARY OF THE INVENTION

Briefly stated, an embodiment of the present invention relates to an overlay for a nonportable amusement device. The nonportable amusement device has a housing, a display, a memory and a controller. The overlay includes one or more panels selectively attachable to and removable from the housing of the nonportable amusement device.

Another preferred embodiment relates to a nonportable amusement device including a housing, a display, a memory, and an overlay selectively attachable to and removable from the housing of the nonportable amusement device.

Another preferred embodiment relates to a nonportable jukebox comprising a display, a controller including a system control program and a communication port, a memory, and a removable overlay. The overlay has one or more predetermined identifiers, one or more light sources, and a controller configured to control operation of the one or more light sources. The overlay is in communication with the communication port of the controller. The system control program is configured to: (i) detect the one or more predetermined identifiers of the overlay, (ii) receive data associated with the one or more predetermined identifiers, (iii) modify and control the content displayed by the display of the amusement device based on data associated with the one or more predetermined identifiers, and (iv) trigger the overlay controller to power up the light sources and cause the overlay to display a light pattern specified by the data associated with the one or more predetermined identifiers.

BRIEF DESCRIPTION OF THE DRAWINGS

The foregoing summary, as well as the following detailed description of preferred embodiments of the invention, will be better understood when read in conjunction with the appended drawings. For the purpose of illustration, there are shown in the drawings embodiments which are presently preferred. It should be understood, however, that the invention is not limited to the precise arrangements and instrumentalities shown.

DETAILED DESCRIPTION OF THE INVENTION

Figure 1A:
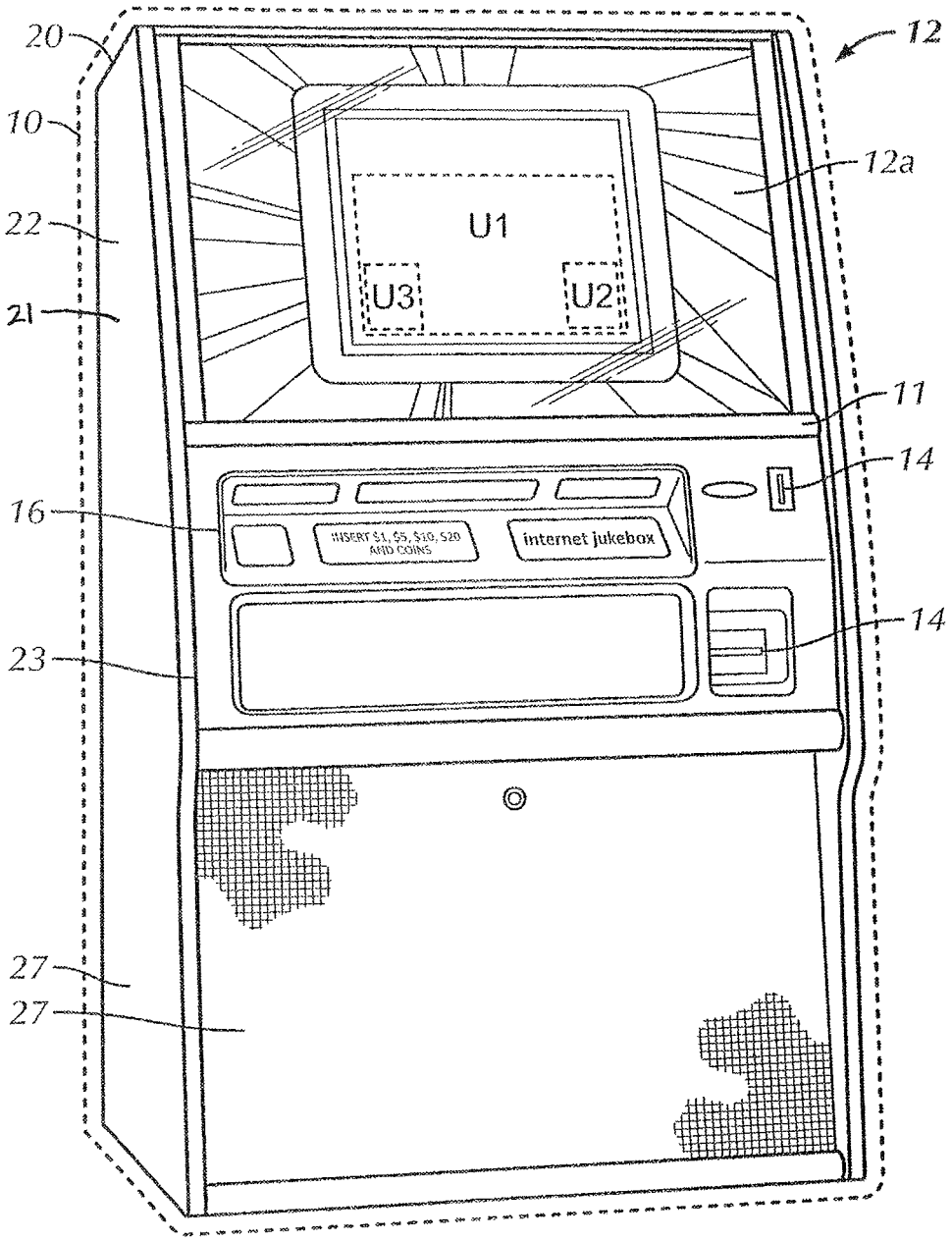
FIG. 1A is a perspective view of an overlay attached to an amusement device in accordance with a first preferred embodiment of the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the apparatus and designated parts thereof. The terminology includes the above-listed words, derivatives thereof, and words of similar import. Additionally, the words "a" and "an", as used in the claims and in the corresponding portions of the specification, mean "at least one." Further, the terms "coin" or "currency" should not be construed as limiting and can be used herein to mean all forms of coin and paper currency from any country as well as proprietary tokens, game cards, credit cards, debit cards, chips, or other representative forms of credit and/or payment.

Figure 1B:
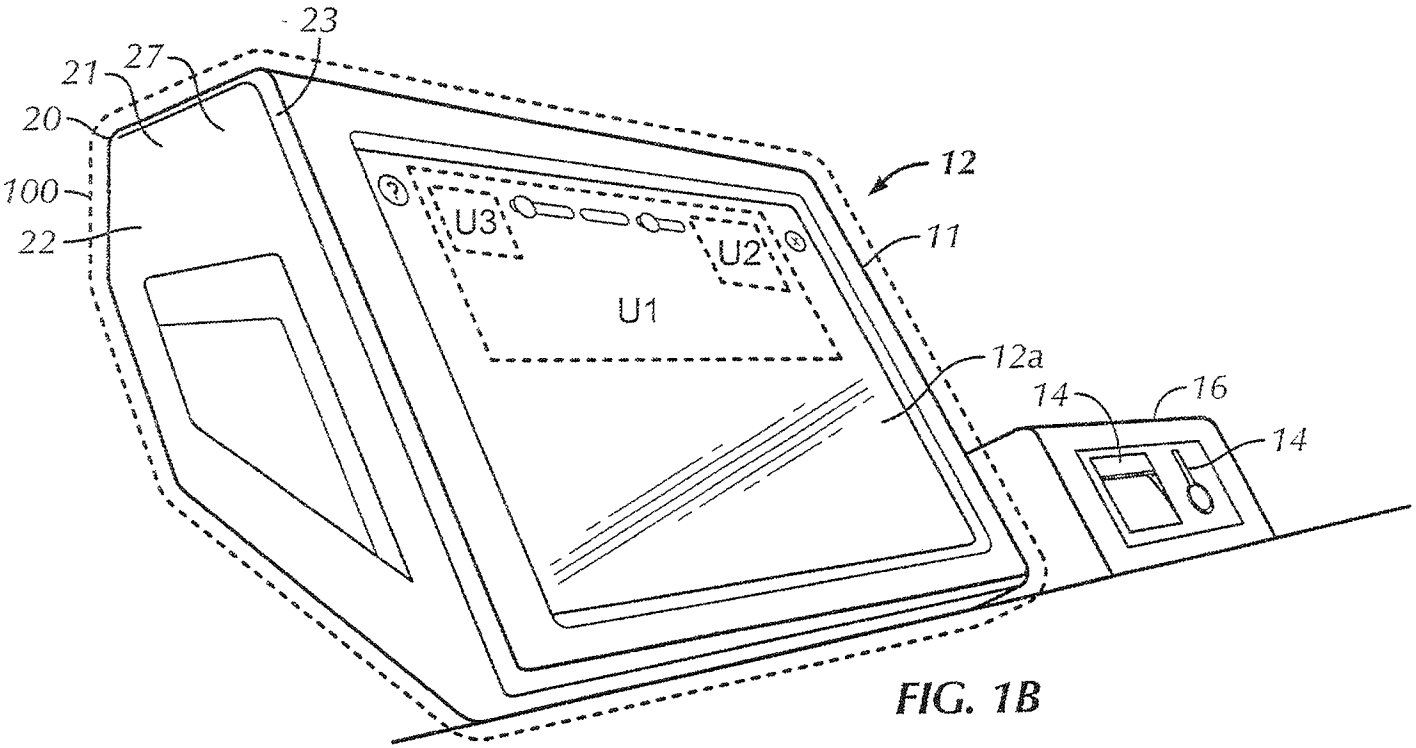
FIG. 1B is a perspective view of an overlay attached to an amusement device in accordance with a second preferred embodiment of the present invention.

In the drawings, like numerals are used to indicate like elements throughout. Referring to the drawings in detail, FIGS. 1A-1B show preferred embodiments of an amusement device 12 including an overlay 10, 100 (shown in phantom in FIGS. 1A and 1B), respectively. While FIGS. 1A-1B show two particular types of money operated jukeboxes 12 including an overlay 10, 100, it will be understood by those skilled in the art that the overlays 10, 100 according to the present invention are designed to be attached to various types of amusement devices which are either coin-operated or free to use.

As is shown in FIGS. 1A-1B, each amusement device 12 includes a housing 21, a controller U1 and a memory U2. The housing 21 is comprised of a frame 23 and a plurality of panels 27. Preferably, both the frame 23 and the panels 27 of the amusement device 12 are generally rigid structures. The panels 27 are preferably attached to the frame 23 by threaded fasteners, adhesives, clips, welded joints, or any appropriate securing mechanism to provide a substantially rigid body or housing 21 of the amusement device 12. It will be understood by those skilled in the art that the housing 21 of the amusement device 12 need not be comprised of multiple components secured to each other, as described herein. Instead, the housing 21 may be constructed of a single piece of material molded or shaped to form the body or housing 21 of the amusement device 12.

A front panel of the housing 21 of the amusement device 12 may be formed as a front access door 11 for servicing internal components of the amusement device 12, especially when the amusement device 12 is mounted to or against a wall (not shown). Preferably, the front access door 11 is a hinged and pivoting door.

The memory U2 can be any known or suitable memory device such as random access memory (RAM), read only memory (ROM), flash RAM, hard disk, optical disk, or the like. The amusement devices 12 each further includes a video display 12*a* that is operatively connected to the controller U1. Preferably, the display 12*a* is a touch input mechanism.

In the context of money operated amusement devices, as shown in FIGS. 1A-1B, the amusement devices 12 each also includes at least one input component 14 that receives value in order to establish one or more playable credits. The value received may be at least one of currency, coins, tokens, chits, credits, credit cards/debit cards, or the like. The amusement devices 12 may include more than one input component 14 to give a user an option for payment, for permitting multiple players, or the like. Preferably, the amusement devices 12 are made operable upon payment by a user, for example, by actuation of the input component 14. In other words, the user may not operate the amusement devices 12 or select and play an electronic game or song until value is received at the input component 14 and/or one or more playable credits are issued to the user. However, free selections may be offered at the discretion of an operator of the amusement devices 12.

The amusement devices 12 may be free-standing or floor-standing apparatuses (as shown in FIG. 1A) or a table-top or counter-top apparatus (as shown in FIG. 1B). The amusement devices 12 may be arranged in any configuration including table mount, wall mount, pole mount, and the like without departing from the invention. Preferably, the amusement device 12 is a nonportable device. A nonportable device means a device which is configured to be mounted or anchored to a support structure, such as a table-top, counter-top, wall, pole or floor.

Further, in the context of money operated amusement devices, the currency module 16 containing the input component(s) 14 may be directly mounted or attached to the amusement device 12 (as shown in FIG. 1A) or may be positioned remotely from the amusement device 12 (as shown in FIG. 1B), preferably a maximum of approximately eighteen inches away from the amusement device 12. However, it will be understood by those skilled in the art that the currency module may be located closer to or farther from the amusement device 12.

The housing 21 of the amusement device 12 is preferably provided with an overlay 10. The overlay 10 is an external cover piece for the amusement device 12 which is configured to be selectively attached to or removed from the housing 21 of the amusement device 12 by the owner or operator thereof. While the overlay 10 is described herein for attachment to an amusement device, and more preferably to the housing of a nonportable amusement device, it will be understood by those skilled in the art that the overlay 10 may be coupled to any type of electronic device having an interface and/or display.

Figure 2A:
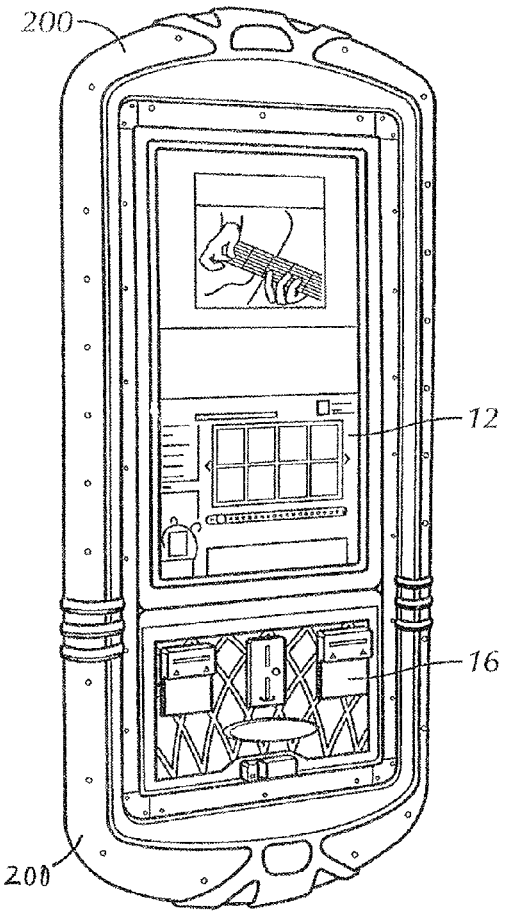
FIG. 2A is a front left perspective view of an overlay attached to an amusement device in accordance with a third preferred embodiment of the present invention.
Figure 2B:
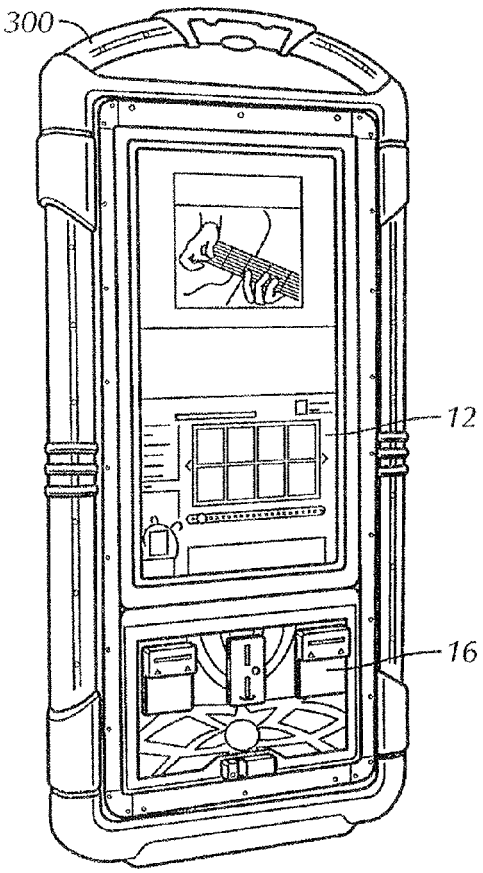
FIG. 2B is a front left perspective view of an overlay attached to an amusement device in accordance with a fourth preferred embodiment of the present invention.
Figure 2C:
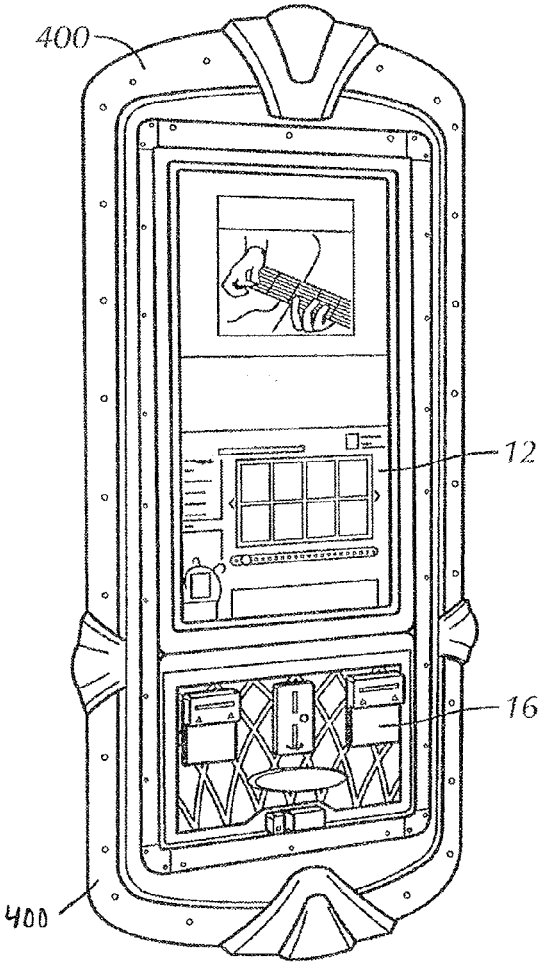
FIG. 2C is a front left perspective view of an overlay attached to an amusement device in accordance with a fifth preferred embodiment of the present invention.
Figure 2D:
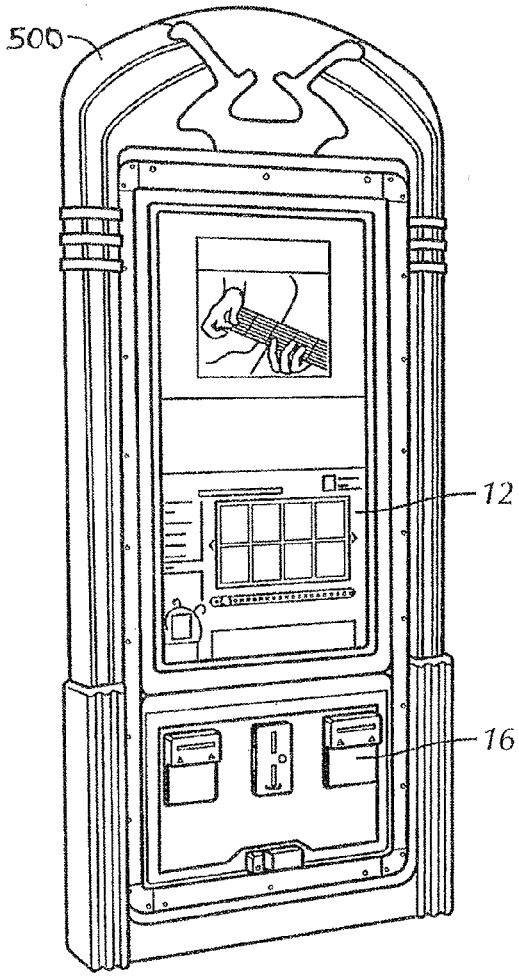
FIG. 2D is a front left perspective view of an overlay attached to an amusement device in accordance with a sixth preferred embodiment of the present invention.

The overlay 10 may be fabricated in a variety of shapes and sizes to facilitate conforming of the overlay 10 to the shapes and sizes of various types of amusement devices 12. For example, FIGS. 2A and 2C depict overlays 200 and 400, respectively, of sufficient size and dimension to wholly or substantially encompass the amusement device 12. Alternatively, FIGS. 2B and 2D show overlays 300 and 500, respectively, of a size so as to only encompass the upper portion of the amusement device 12, not including the currency module 16. Alternatively, an overlay 100 may be designed to be of a relatively smaller size so as to be of a sufficient size to wholly or substantially encompass the types of amusement devices 12 depicted in FIG. 1B.

Figure 3:
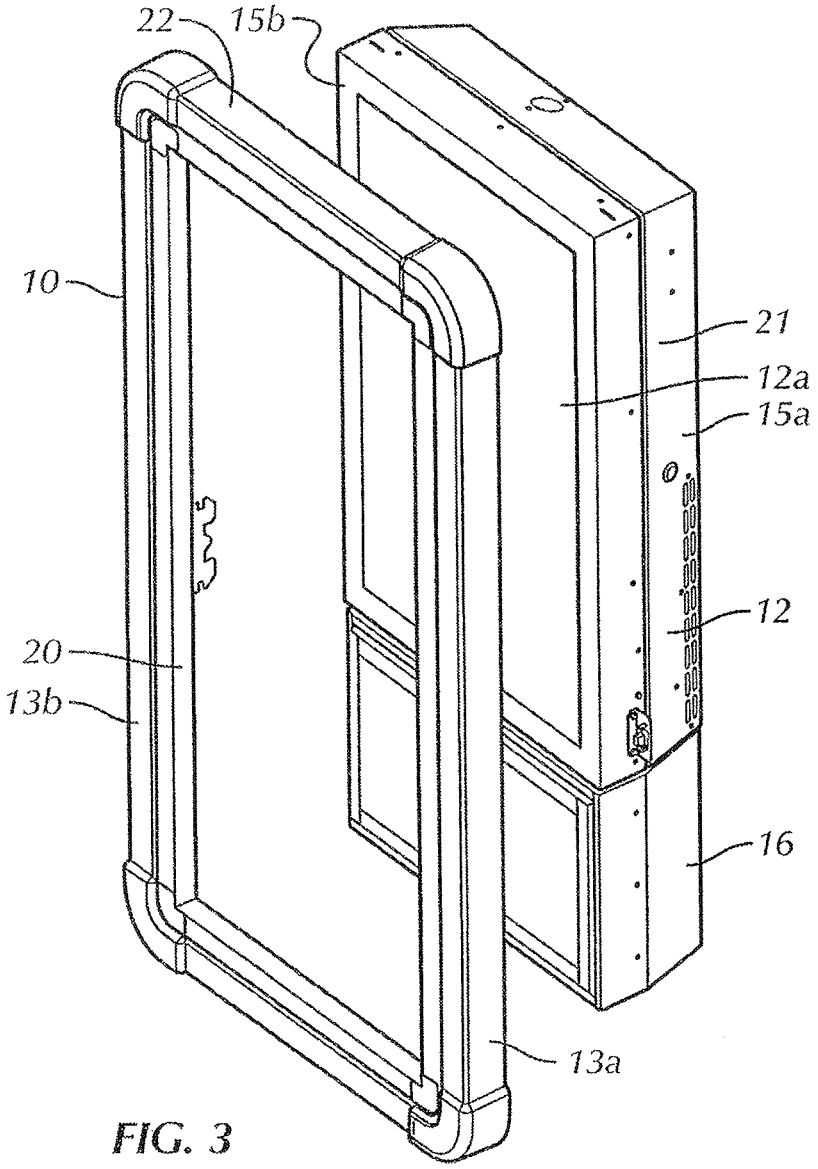
FIG. 3 is a front right perspective exploded view of an overlay and amusement device in accordance with preferred embodiments of the present invention.

A detailed description of the overlay 10 is provided herein with reference to FIG. 3, which depicts a generally basic type of overlay 10. Generally, the overlay 10 has a depth of approximately 3-12 inches. However, it will be understood by those skilled in the art that the overlay 10 may have any size as necessary to conform to the size and/or portion of the amusement device 12 to be covered.

In one embodiment, the overlay 10 preferably comprises one or more panels 22. In one embodiment, the panels 22 are preferably diffuser panels. More preferably, the panels 22 are diffuser panels made of a polymeric material and, more preferably, of a plastic material. Examples of the plastic that may be used include, but are not limited to acrylic, acrylonitrile butadiene styrene (ABS), polycarbonate, polyethylene terephthalate glycol (PETG.), and combinations thereof. The diffuser panels 22 are also preferably backlit and substantially rigid. The diffuser panels 22 are preferably fabricated from a plastic sheet material which is molded using vacuum forming techniques. The diffuser panels 22 may be transparent, translucent, opaque or any combination thereof. Artwork may be printed on, screened on, or otherwise applied to the diffuser panels 22 before or after the formation process to further customize the panels 22 to achieve a desired look. Multiple diffuser panels 22 may be laminated or layered upon each other using adhesive, mechanical, or other fastening techniques to create other distinctive appearances.

In another embodiment, the panels 22 are preferably stained wood panels. Alternatively, in another embodiment, the panels 22 of the overlay 10 may comprise a flexible and pliant material to facilitate conforming of the overlay 10 to the particular contours of various types of amusement devices 12. In another embodiment, the overlay 10 may comprise a combination of diffuser panels, stained wood panels and/or flexible panels.

In one embodiment, the overlay 10 preferably also comprises a generally rigid frame 20. The frame 20 is preferably fabricated of a sheet metal, such as cold rolled steel or aluminum, and then preferably painted or otherwise treated to protect against corrosion. The panels 22 are preferably attached to the frame 20 by threaded fasteners, adhesives, clips, or any appropriate securing mechanism to provide a substantially rigid, secure overlay 10. Once attached to the housing 21 of the amusement device 12, the overlay 10 serves as a physical and interchangeable cover for the stand-alone amusement device 12.

To attach or couple the overlay 10 to the housing 21 of the amusement device 12, the overlay 10 is placed or hung over the amusement device housing 21, such that the overlay 10 at least partially or wholly encompasses the body of the amusement device 12, and is subsequently secured to the amusement device 12. The overlay 10 may be configured to only encompass the upper portion of the housing 21 of the amusement device 12, not including the currency module 16, such as the overlays 300 and 500 shown in FIGS. 2B and 2D, respectively. Such a configuration allows the currency module 16 to be easily accessed without the need for removing the attached overlay 10. Preferably, one or more faces or panels of the currency module 16 are also interchangeable and may be partially or fully lighted, such that the currency module 16 may be outfitted with panels that match or complement the overlay 10 attached to the amusement device 12.

Figure 4:
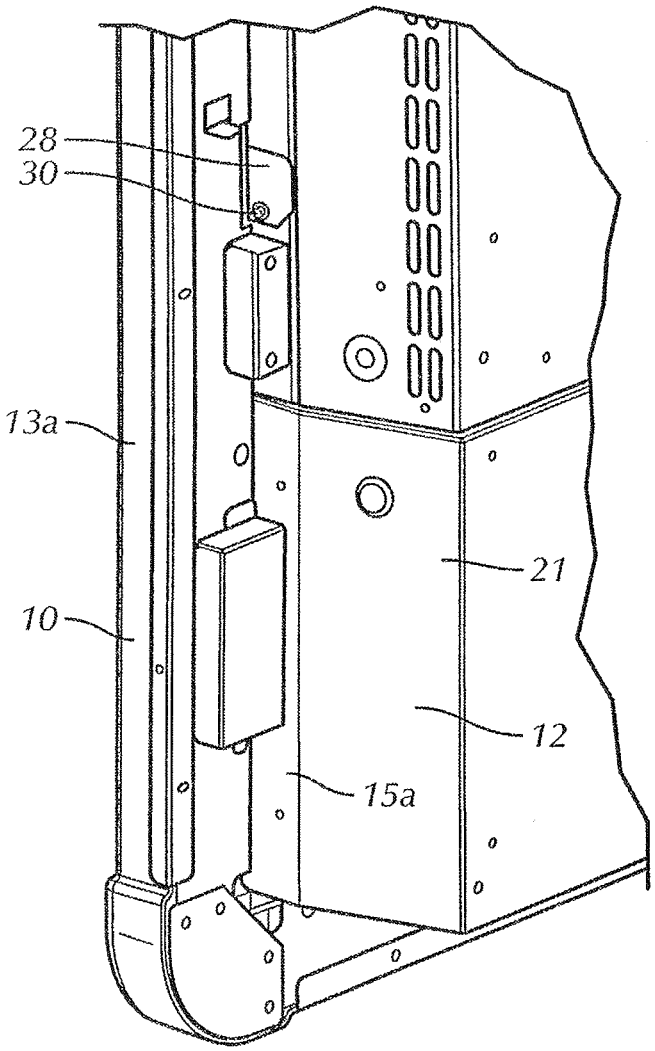
FIG. 4 is an enlarged partial rear right perspective view of a connection between an overlay and an amusement device in accordance with preferred embodiments of the present invention.
Figure 5:
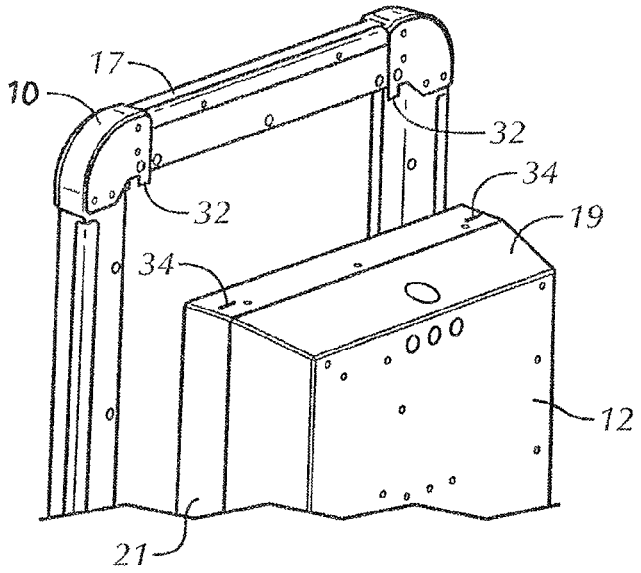
FIG. 5 is an enlarged partial rear perspective view of a connection between an overlay and an amusement device in accordance with preferred embodiments of the present invention.

Any appropriate securing mechanism or fastener may be utilized for attaching the overlay 10 to the housing 21 of the amusement device 12. Preferably, a plurality of securing mechanisms or fasteners are provided on each lateral side of the housing 21 of the amusement device 12 and the overlay 10. Examples of the securing mechanisms include, but are not limited to, hook and latch assemblies, hook and loop fasteners, snaps, adhesives and the like. More particularly, referring to FIGS. 3-4, each lateral side 13*a*, 13*b* of the overlay 10 includes at least one hook or catch 28, but more preferably a plurality of hooks or catches 28, configured to engage with one or more corresponding latches or fasteners 30 provided on each of the lateral sides 15*a*, 15*b* of the housing 21 of the amusement device 12. More preferably, referring to FIG. 5, in addition to the securing mechanisms provided on the lateral sides 13*a*, 13*b*, 15*a*, 15*b*, an interior surface of the upper end 17 of the overlay 10 is provided with one or more protrusions or tabs 32 configured to engage with one or more corresponding slots 34 formed in an exterior surface of the upper end 19 of the housing 21 of the amusement device 12.

Thus, to secure the overlay 10 to the housing 21 of the amusement device 12, the operator first hangs the overlay 10 on the housing 21 of the amusement device 12 and then pulls down on the overlay 10, such that the protrusions 32 of the overlay 10 engage with and are received within the slots 34 of the amusement device housing 21. Next, the operator pushes the overlay 10 back toward the amusement device 12, such that the hooks 28 of the overlay 10 engage with the latches 30 of the amusement device housing 21.

Once the overlay 10 is secured to the housing 21 of the amusement device 12, the overlay 10 becomes integral with the front face or panel of the housing 21 of the amusement device 12. When the amusement devices housing 21 is equipped with a front access door 11, the overlay 10 remains secured to the front access door 11 and is pivotable together with the front access door 11 relative to the remainder of the amusement device 12. Thus, the interior components of the amusement device 12 may be easily accessed, even after the amusement device 12 is equipped with an overlay 10, simply by grabbing and pulling the overlay 10 and front access door 11 in a direction away from the amusement device 12.

From the foregoing, it should be understood by those skilled in the art that the overlay 10 is an accessory to the amusement device 12 which facilitates efficient and inexpensive alteration, modification or enhancement of the exterior appearance of the housing 21 of the amusement device 12. However, the amusement device 12 is generally a stand-alone, operable and usable device when the overlay 10 is detached from the amusement device 12.

The overlay 10 preferably has one or more selectively modifiable visual characteristics. Examples of such visual characteristics are images, graphics, colors, lighting, text, style and design depicted on or by the overlay 10. Preferably, one or more of the visual characteristics of the overlay 10 are controlled by one or more light sources. More preferably, the overlay 10 may be of a single or multiple colors created by one or more electrically powered lights. The colors presented by the overlay 10 may remain the same throughout use of the overlay 10, or may have a changing and recurring pattern, such that the amusement device 12 and overlay 10 have an animated appearance. The overlay 10 may be equipped with other electrically driven elements, as an alternative to or in addition to electrically powered lights, including but not limited to motorized movement of components, a clock or timer, a scrolling marquee and the like. Examples of the motorized movement that may be included are spinning or waving by components of the overlay 10.

Figure 7C:
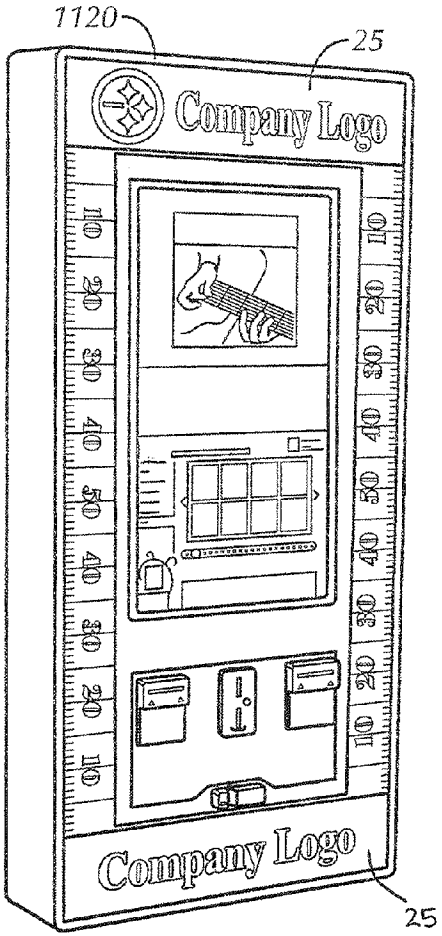
FIG. 7C is a front left perspective view of an overlay attached to an amusement device in accordance with a thirteenth preferred embodiment of the present invention.
Figure 7B:
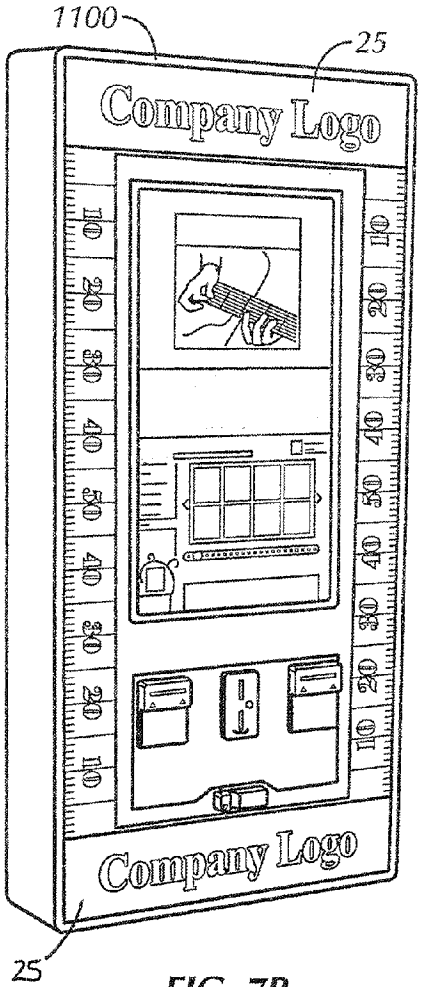
FIG. 7B is a front left perspective view of an overlay attached to an amusement device in accordance with a twelfth preferred embodiment of the present invention.
Figure 7A:
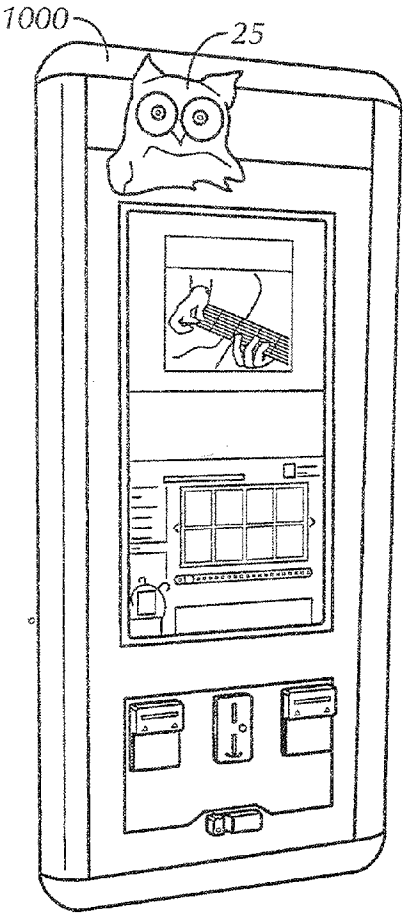
FIG. 7A is a front left perspective view of an overlay attached to an amusement device in accordance with a eleventh preferred embodiment of the present invention.
Figure 8A:
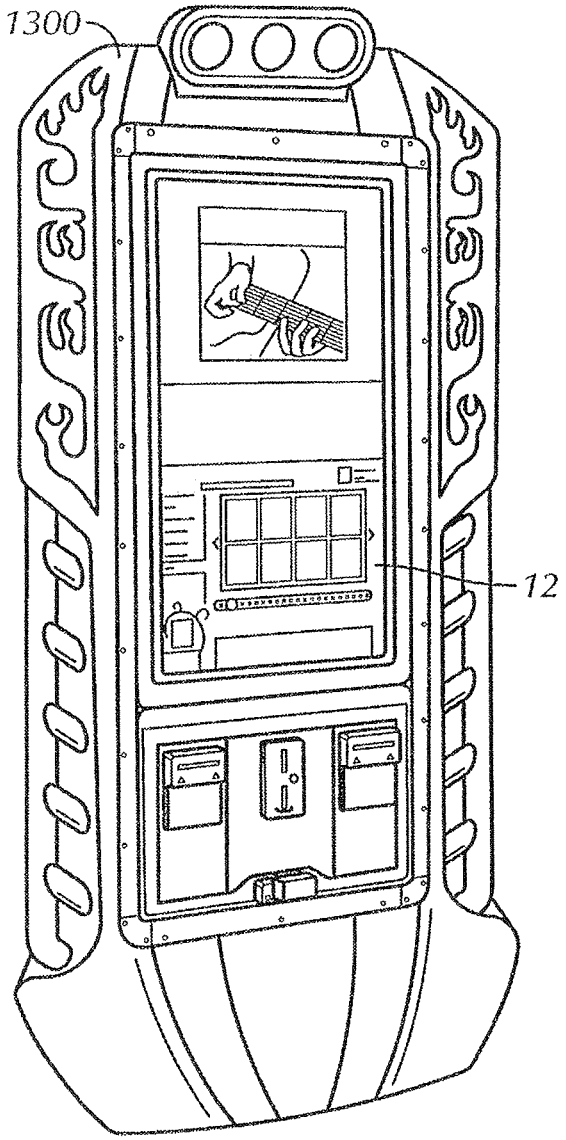
FIG. 8A is a front left perspective view of an overlay attached to an amusement device in accordance with a fourteenth preferred embodiment of the present invention.
Figure 8B:
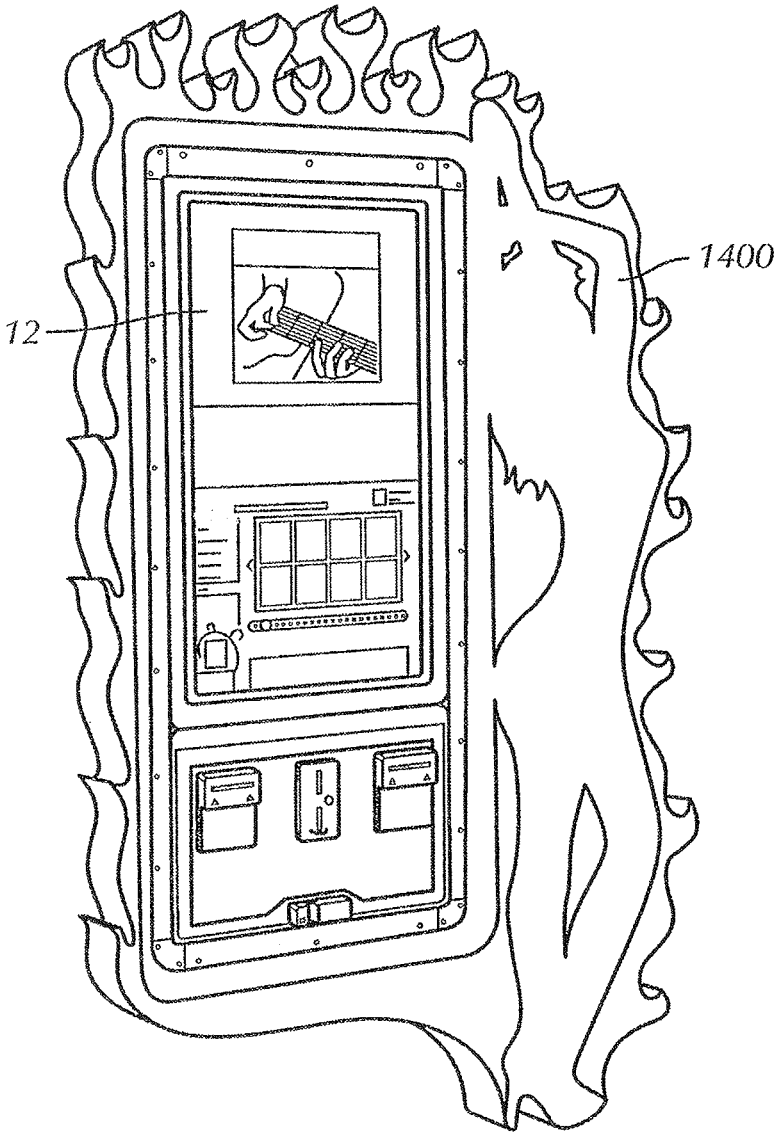
FIG. 8B is a front left perspective view of an overlay attached to an amusement device in accordance with a fifteenth preferred embodiment of the present invention.
Figure 8C:
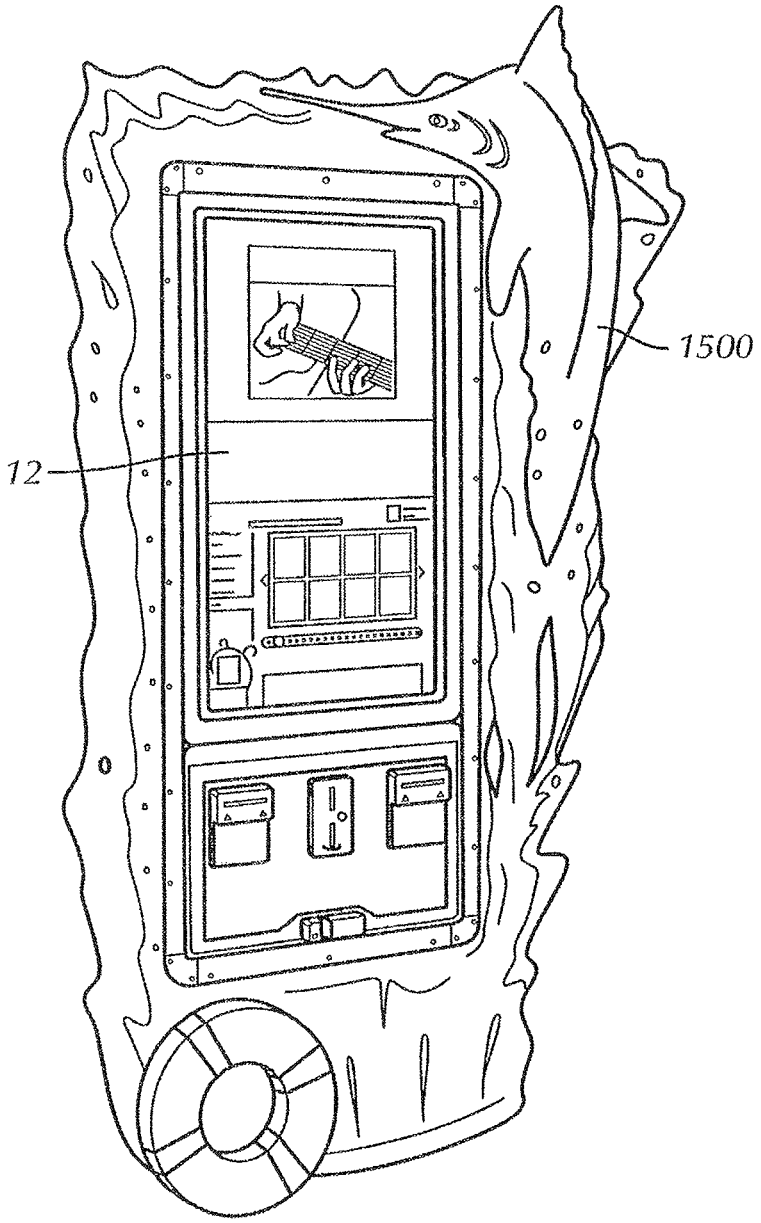
FIG. 8C is a front left perspective view of an overlay attached to an amusement device in accordance with a sixteenth preferred embodiment of the present invention.
Figure 8D:
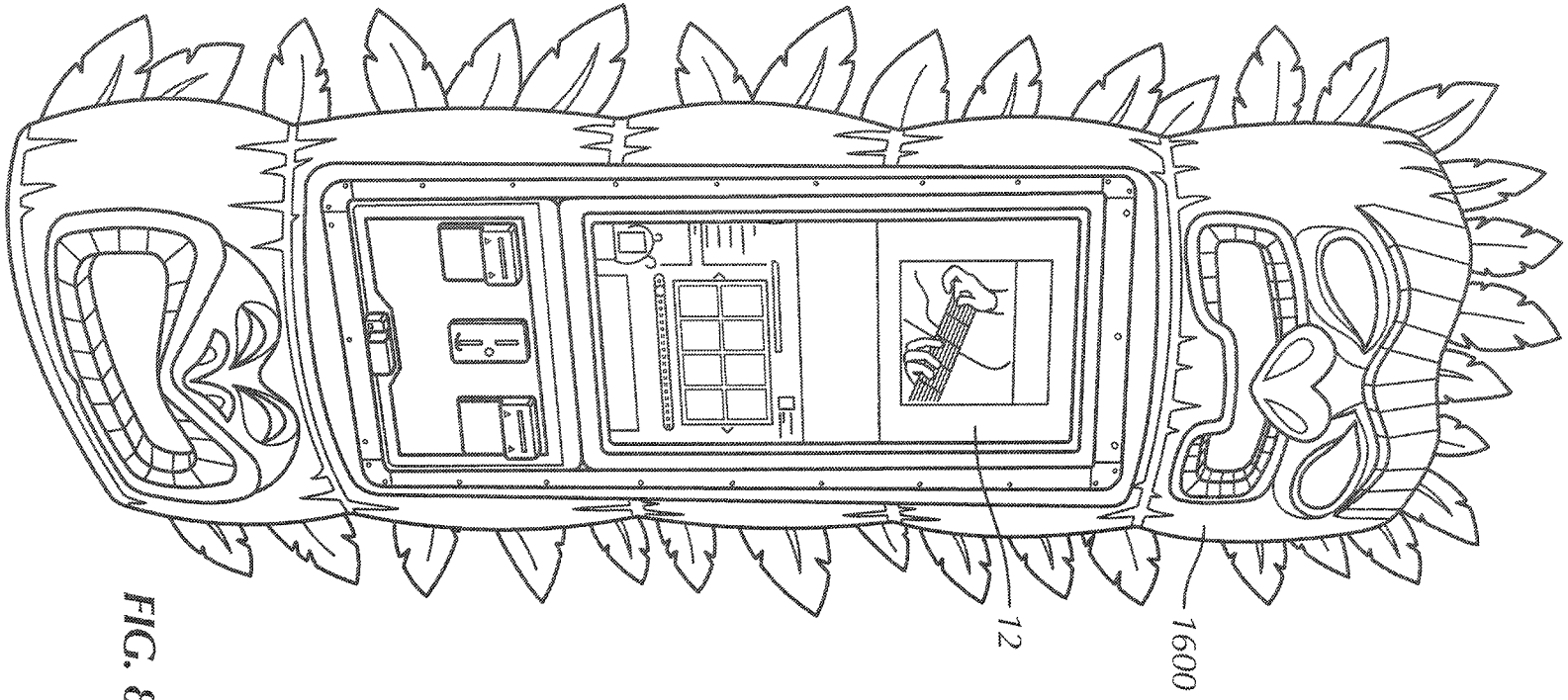
FIG. 8D is a front left perspective view of an overlay attached to an amusement device in accordance with a seventeenth preferred embodiment of the present invention.

According to one embodiment, the overlay 10 is generally unadorned, such that a relatively simple, but upgraded, appearance is achieved by attachment of the overlay 10 to an amusement device 12. FIGS. 6A-6D depict overlays 600, 700, 800, 900, respectively, having such a simple, but elegant appearance. FIG. 7A depicts an overlay 1000 having a relatively simple appearance, but which is adorned with a panel 25 displaying a particular restaurant's logo. The panel 25 may be selectively removable and interchangeable, such that the panel 25 may be removed and replaced with a panel depicting a different logo, graphic, image, illustration or text to quickly and cost-efficiently modify the visual characteristics of the overlay 10 and give the amusement device 12 a new or modified visual appearance. For example, the panel 25 may include the names and/or logos of sports teams, colleges/universities, restaurants, bars, or the like. FIGS. 7B-7C depict overlays 1100, 1200, respectively, having the appearance of a football field, but which are also equipped with interchangeable panels 25, thereby making the overlays 1100, 1200 easily modifiable and customizable.

According to another embodiment, the overlay 10 may have a more ornate, decorative appearance to reflect or replicate a particular style or theme or to evoke a particular impression. For example, the overlay 10 may also have the style of a nostalgic bubbler jukebox, a retro-style jukebox, a contemporary jukebox, a futuristic jukebox, and the like. FIGS. 8A-8D depict overlays 1300, 1400, 1500, 1600, respectively, having particularly ornate appearances.

The overlay 10 may also have a shape and style specific to a particular owner's or operator's business. The overlay 10 may also be given a custom appearance to satisfy the particular requirements or desires of an amusement device owner/operator. For example, if the amusement device 12 is located at a diner outfitted with a 1950's style decor, the overlay 10 may have an appearance that complements the diner's retro environment, colors, decor and the like.

Figure 9:
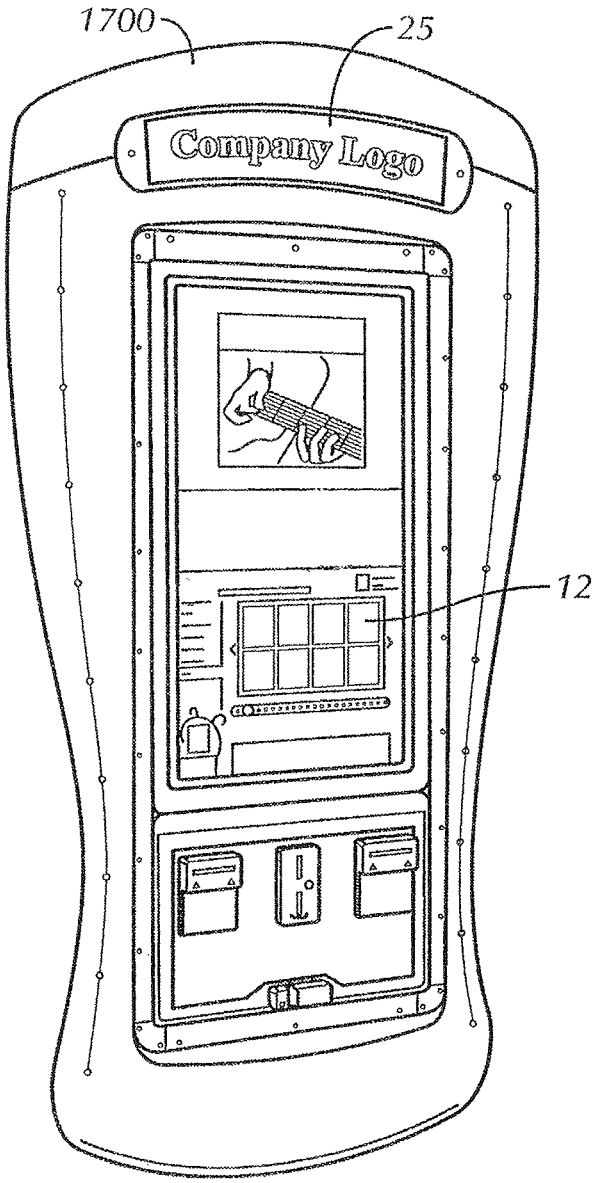
FIG. 9 is a front left perspective view of an overlay attached to an amusement device in accordance with a eighteenth preferred embodiment of the present invention.

Alternatively, as shown in FIG. 9, an overlay 1700 may be in the shape of a pint glass, such that the overlay 1700 is particularly suited for a bar or restaurant in a college setting. The overlay 1700 also includes an interchangeable panel 25.

Figure 10A:
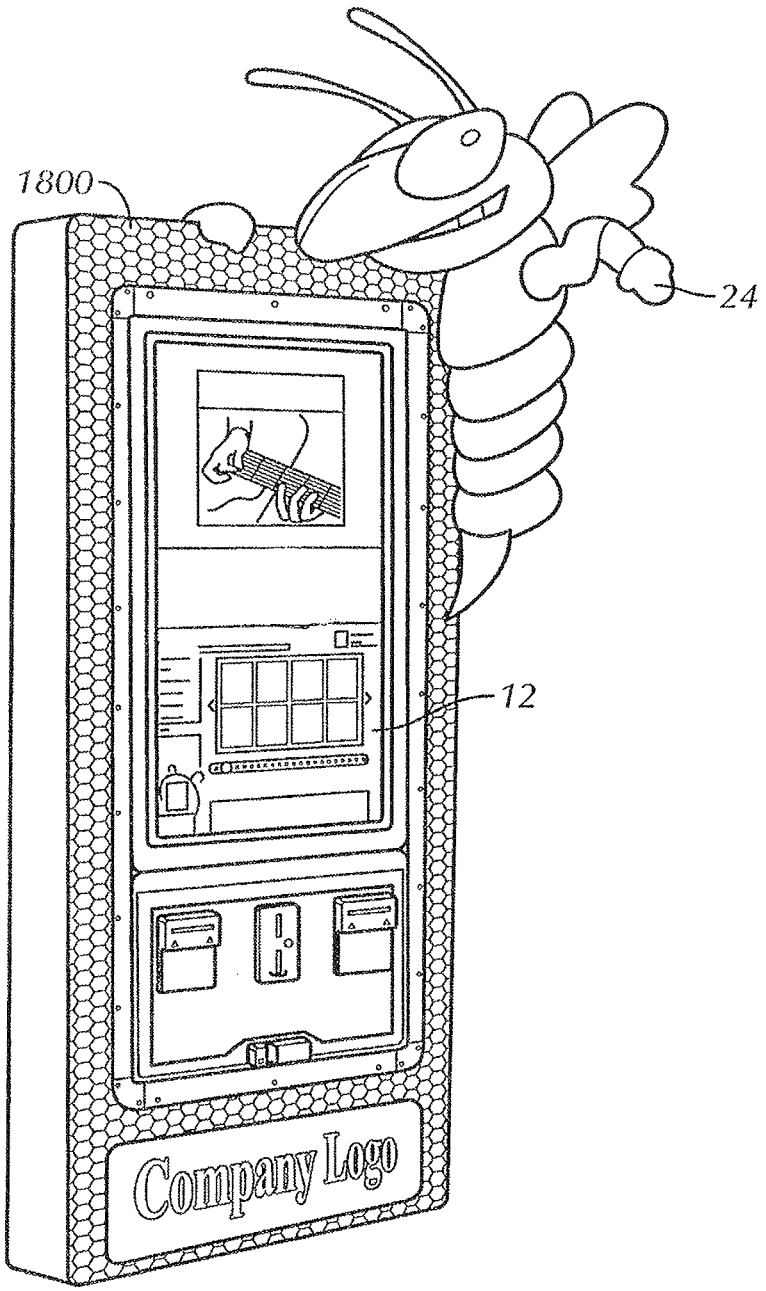
FIG. 10A is a front left perspective view of an overlay attached to an amusement device in accordance with a nineteenth preferred embodiment of the present invention.
Figure 10B:
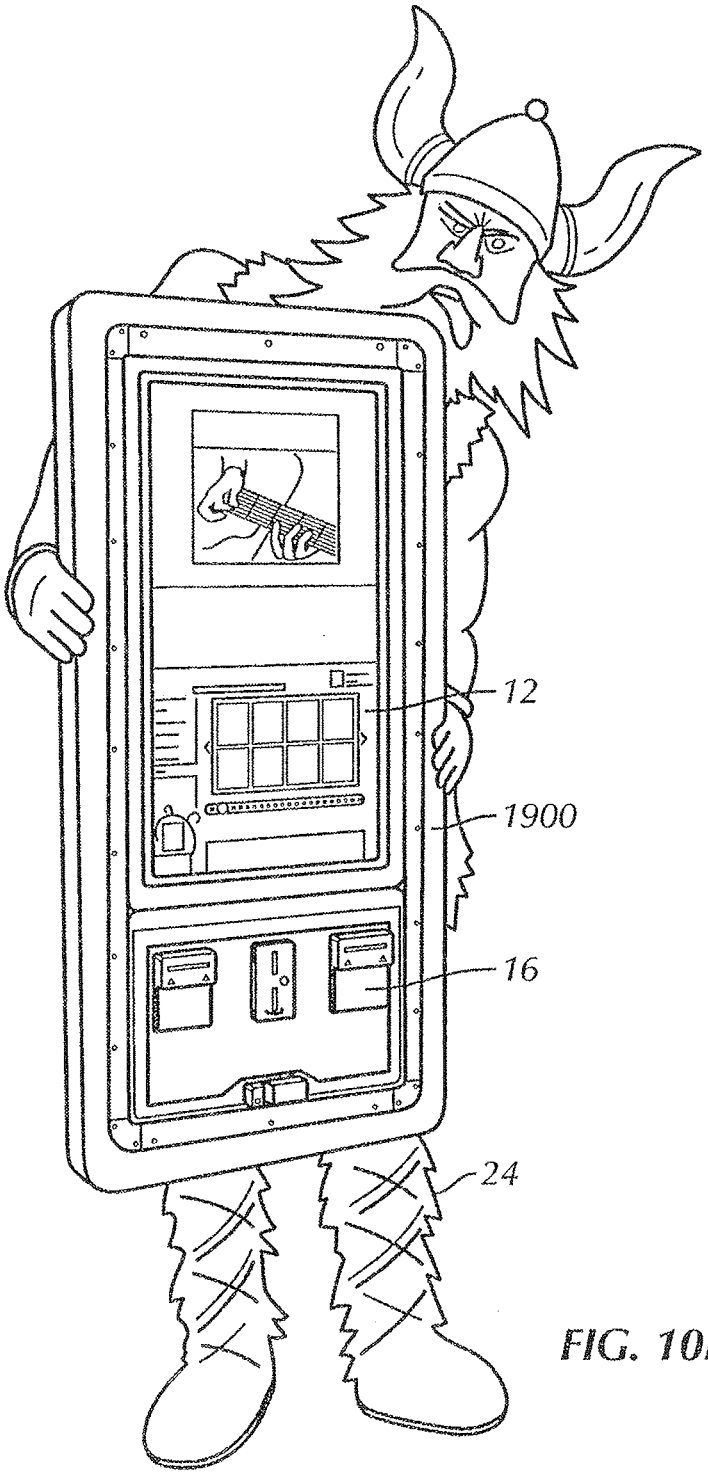
FIG. 10B is a front left perspective view of an overlay attached to an amusement device in accordance with a twentieth preferred embodiment of the present invention.
Figure 10C:
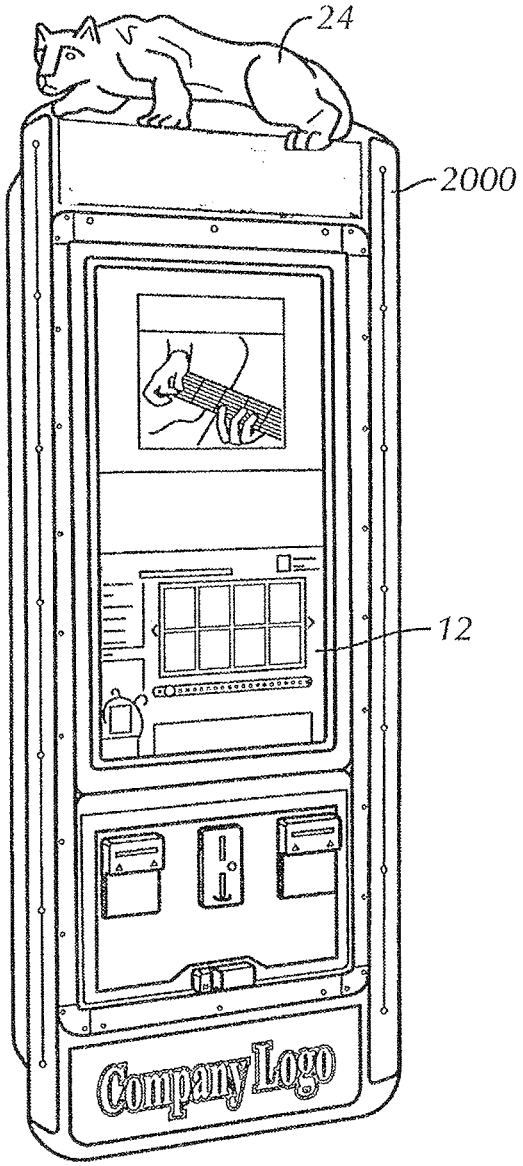
FIG. 10C is a front left perspective view of an overlay attached to an amusement device in accordance with a twenty-first preferred embodiment of the present invention.
Figure 11A:
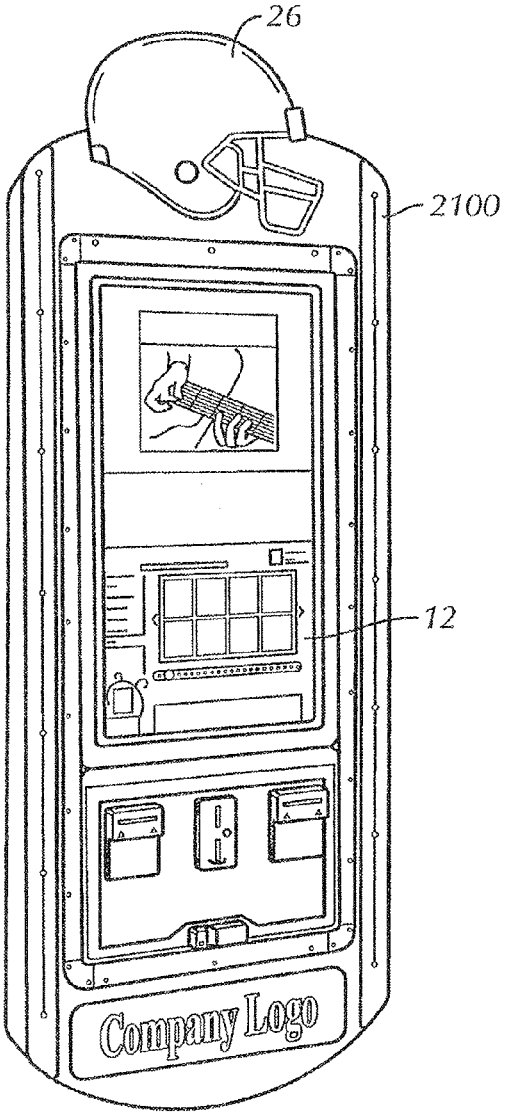
FIG. 11A is a front left perspective view of an overlay attached to an amusement device in accordance with a twenty-second preferred embodiment of the present invention.
Figure 11B:
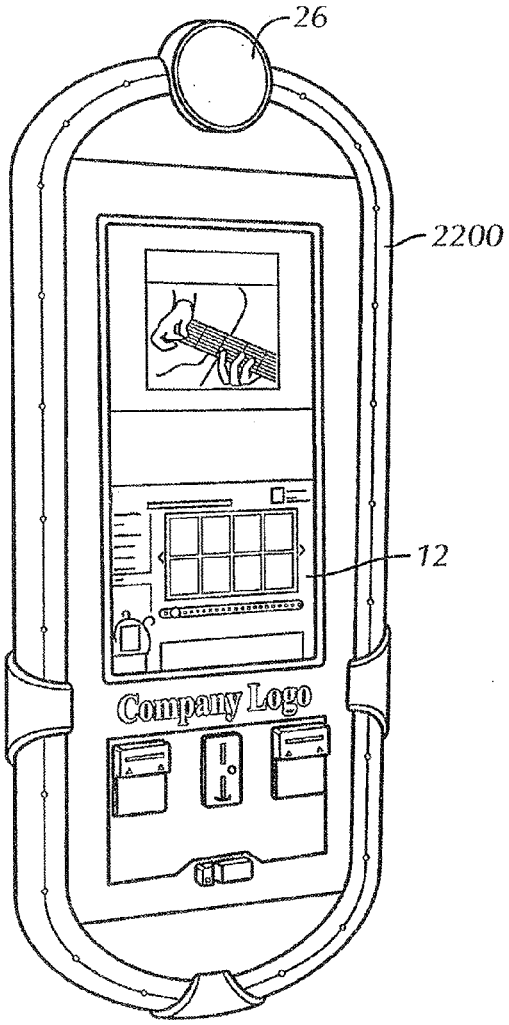
FIG. 11B is a front left perspective view of an overlay attached to an amusement device in accordance with a twenty-third preferred embodiment of the present invention.
Figure 11C:
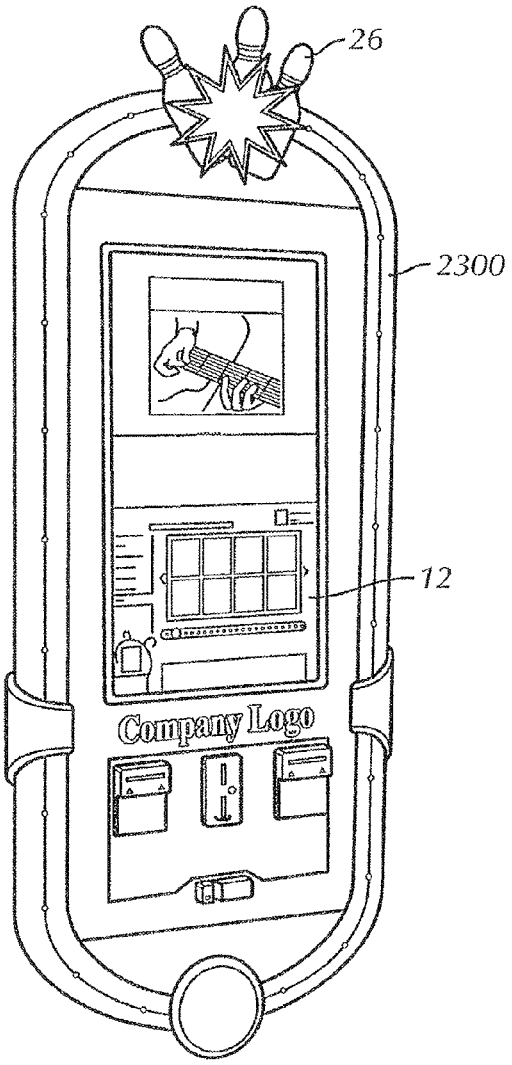
FIG. 11C is a front left perspective view of an overlay attached to an amusement device in accordance with a twenty-fourth preferred embodiment of the present invention.
Figure 11D:
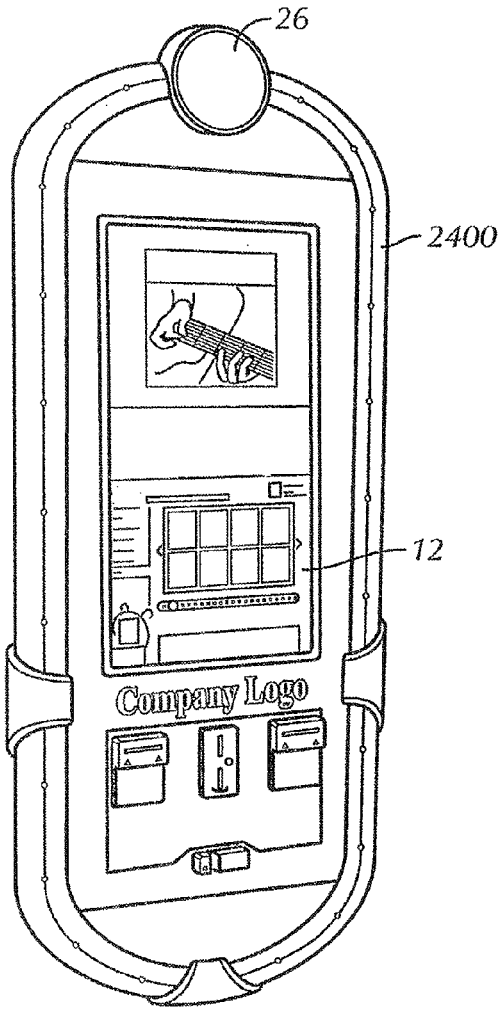
FIG. 11D is a front left perspective view of an overlay attached to an amusement device in accordance with a twenty-fifth preferred embodiment of the present invention.

In another embodiment, the overlay 10 may include various accessories or ornamental components to give the overlay 10 a more distinct and custom appearance. For example, FIGS. 10A-10C depict overlays 1800, 1900, 2000, respectively, each of which includes an accessory 24 representing an entity's mascot. Preferably, the accessory 24 or at least a part thereof is interchangeable. Alternatively, as shown in FIGS. 11A-11D, the overlays 2100, 2200, 2300, 2400, respectively, have relatively simple appearances, but are each equipped with an interchangeable component or icon 26, such that the look or appearance of the overlays 2100, 2200, 2300, 2400 and the amusement device 12 may be transformed for minimal expense and in a very short period of time. For example, the icon 26 may include the names and/or logos of sports teams, colleges/universities, restaurants, bars and the like.

The present invention facilitates easy attachment and removal of the overlay 10 to and from the amusement device 12, and more particularly the housing 21 of the amusement device 12, providing for increased flexibility in the use of the amusement device 12. Thus, the appearance of a relatively basic or plain amusement device 12 can be upgraded in an efficient and cost-effective manner simply by attaching the overlay 10 of the desired appearance to the amusement device 12. Similarly, owners/operators can alter the appearance of amusement devices 12 quickly and efficiently.

Figure 13:
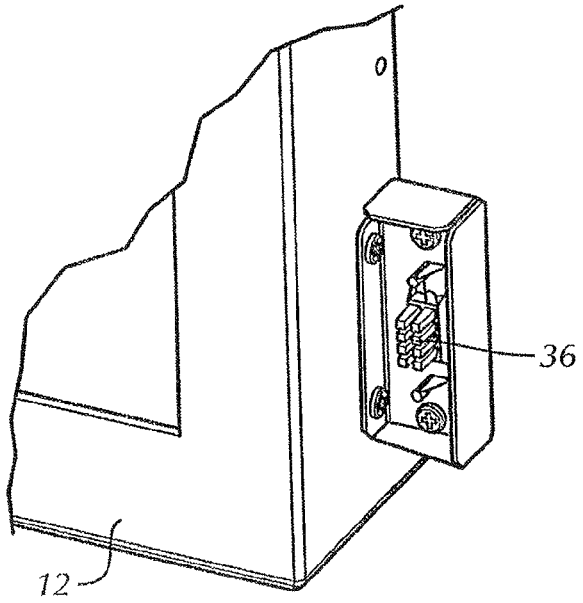
FIG. 13 is an enlarged partial front perspective view of a connector of an amusement device in accordance with preferred embodiments of the present invention.
Figure 6A:
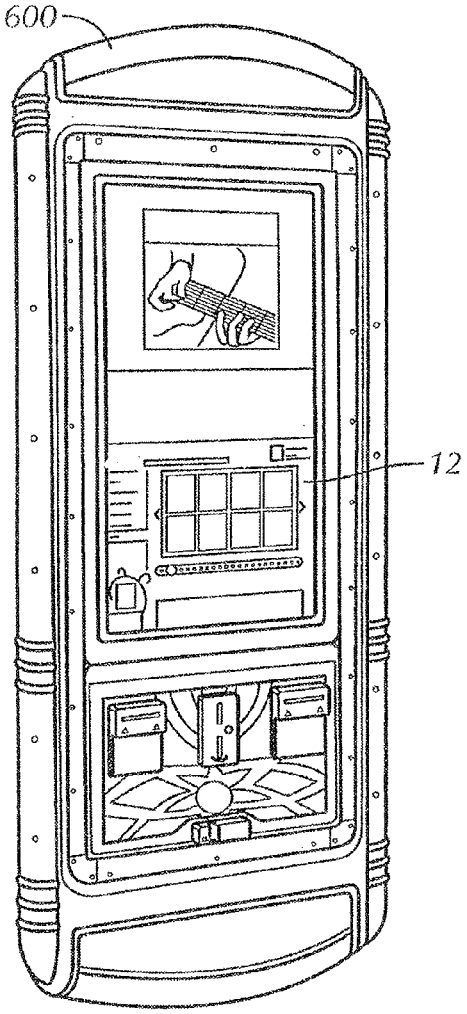
FIG. 6A is a front left perspective view of an overlay attached to an amusement device in accordance with a seventh preferred embodiment of the present invention.
Figure 6B:
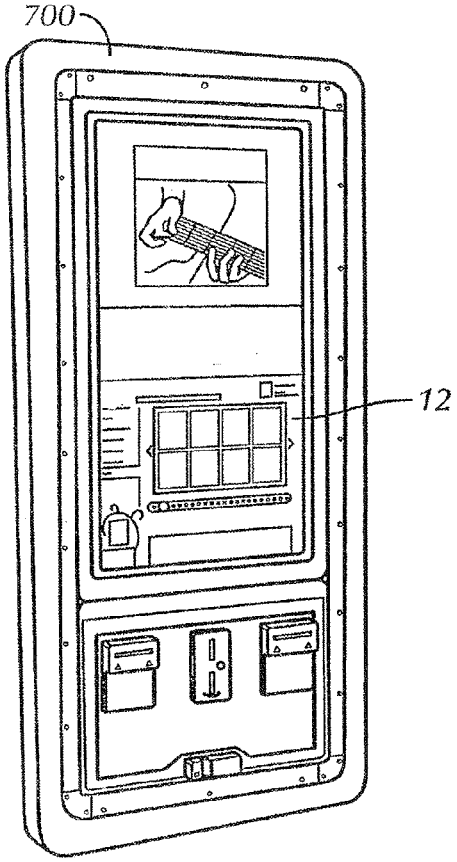
FIG. 6B is a front left perspective view of an overlay attached to an amusement device in accordance with a eighth preferred embodiment of the present invention.
Figure 6C:
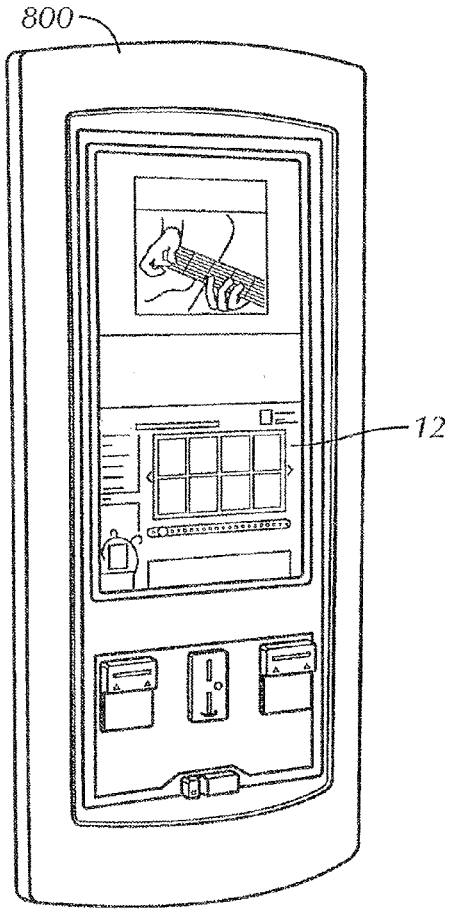
FIG. 6C is a front left perspective view of an overlay attached to an amusement device in accordance with a ninth preferred embodiment of the present invention.
Figure 6D:
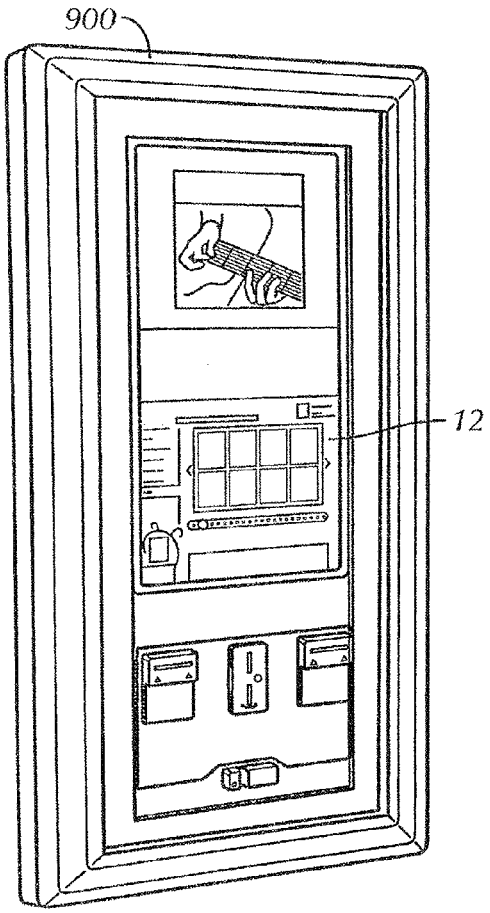
FIG. 6D is a front left perspective view of an overlay attached to an amusement device in accordance with a tenth preferred embodiment of the present invention.
Figure 12:
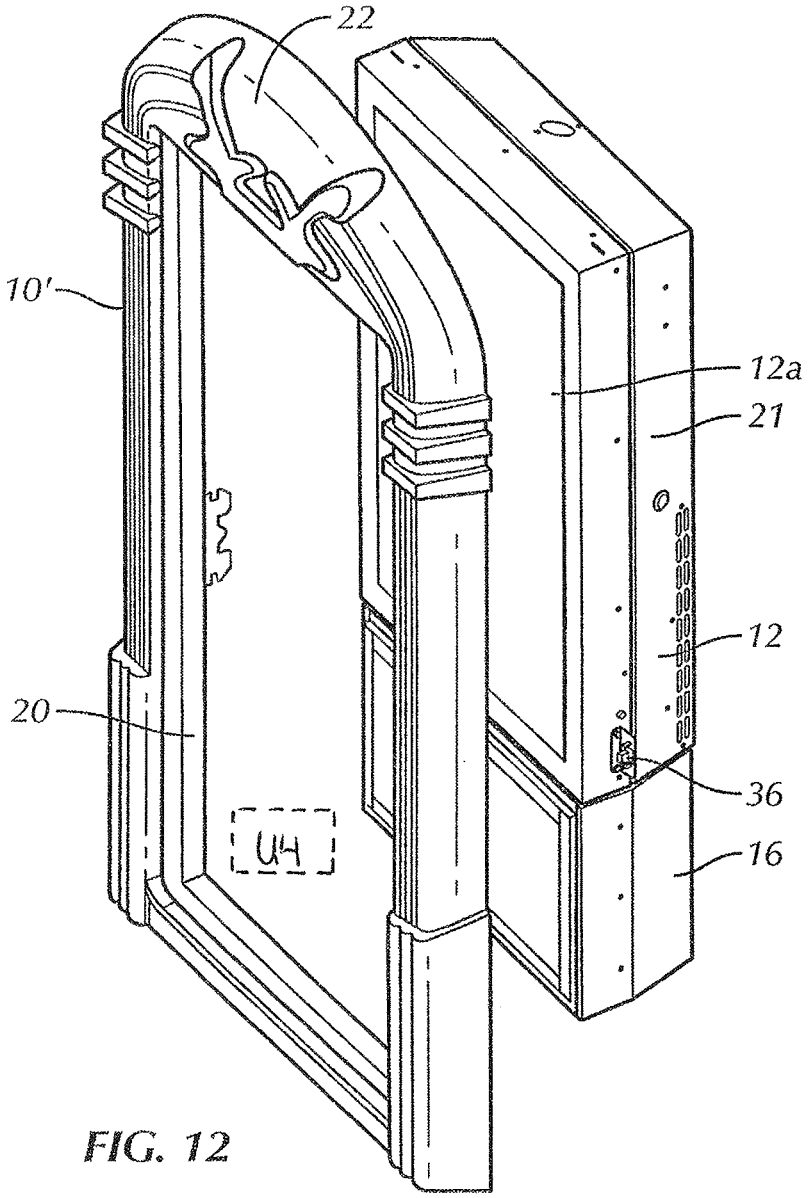
FIG. 12 is a front right perspective exploded view of an overlay and amusement device in accordance with preferred embodiments of the present invention.

In another embodiment, referring to FIGS. 12-13, an overlay 10' comprises an electronic controller U4 that controls the light sources built into the overlay 10'. The overlay 10' is also associated with a predetermined identifier or, alternatively, a plurality of predetermined identifiers, which relate to the particular style of the overlay 10'. Examples of the predetermined identifiers include, but are not limited to, one or more colors, patterns, advertisements, videos, songs and the like.

The overlay 10' is not only physically connected to the housing 21 of the amusement device 12, but is also operatively connected to the amusement device 12. Once the overlay 10' is electrically and operatively connected to the housing 21 of the amusement device 12, the controller U4 of the overlay 10' automatically powers up the lights of the overlay 10', such that the overlay 10' automatically presents the colors and/or patterns of light specified by the default identifier or identifiers of that particular overlay 10'. Alternatively, the controller U1 of the amusement device 12 may control operation of the lights of the overlay 10'.

According to one embodiment, when the overlay 10' is mechanically or physically connected to the housing 21 of the amusement device 12, an automatic connection of the power and communication lines of the overlay 10' and the amusement device 12 is achieved. One skilled in the art will understand that such an automatic connection may be achieved by a variety of methods, connectors and/or contacts. For example, as shown in FIG. 13, the housing 21 of the amusement device 12 may be equipped with a blind mate connector 36 to which the overlay 10' is connected for achieving an automatic connection between the amusement device 12 and the overlay 10'. In another embodiment, a separate manual action is employed via an inline connector in order achieve the electrical connection and communication between the overlay 10' and the amusement device 12.

More specifically, the overlay 10' is preferably in communication with the main circuit board or controller U1 of the amusement device 12 via a communication port of the controller U1. Preferably, the overlay 10' connects to a serial input/output interface in the amusement device 12. The controller U4 of the overlay 10' preferably includes a communication circuit which enables serial communication between the overlay 10' and the electronics of the amusement device 12. The overlay 10' also preferably includes one or more electronic components, such as a microprocessor and a memory chip, which store one or more predetermined identifiers or characteristics of the overlay 10' to be communicated, transferred or input to the controller U1 when the overlay 10' is installed.

In one embodiment, the overlay 10' is in direct communication with the controller U1 by a universal serial bus port, a serial port, a parallel port, a firewire port, an ethernet port, IEEE 802.11 protocols, IrDA protocols, an LPC-compatible interface device, and the like. According to another embodiment, the overlay 10' is in communication with the controller U1 via an interface card, where the overlay 10' is connected to the interface card by an integrated circuit bus, local area network, RS232 bus, RS485 bus and the like. In yet another embodiment, the overlay 10' is in communication with the controller U1 or interface card using wireless communication technologies such as Blue Tooth or Wi-Fi and the like. Alternatively, an installer of the overlay 10' may change a setting of the controller U1, memory U2 or other component of the amusement device 12 in accordance with the installation of a particular overlay 10'.

Once the overlay 10' is connected to and in communication with the controller U1, the operating system of the amusement device 12 preferably automatically detects the connected overlay 10', queries the overlay 10', activates the overlay 10' and begins communicating with the overlay 10'.

In another embodiment, once the overlay 10' is in communication with the controller U1, an installer of the overlay 10' may reprogram some of the settings of the operating system of the amusement device 12 to prompt the operating system to begin the detection and communication activities. Alternatively, once the overlay 10' is connected to the controller U1, an installer of the overlay 10' may reprogram some of the settings of the operating system to manually effect detection of and communication with the overlay 10' by the amusement device 12.

Upon establishing communication between the overlay 10' and the amusement device 12, the predetermined identifier or identifiers are communicated to the amusement device 12 and, in particular, to the system control program or system software U3 of the controller U1. Specifically, once the overlay 10' is in communication with the amusement device 12, the system control program U3 of the amusement device 12 is configured to detect the predetermined identifier or identifiers of the overlay 10', receive data associated with the predetermined identifier or identifiers, and use such data to modify or control the appearance of the overlay 10' and the content displayed by the display 12*a* of the amusement device 12. More particularly, the system control program U3 of the amusement device 12 determines which style of overlay 10' is installed and is preferably automatically triggered to load appropriate defaults associated with the predetermined identifier or identifiers of the operatively connected overlay 10'. Alternatively, the installer may manually prompt the system control program U3 to do so.

Thus, once the predetermined identifier or identifiers of the overlay 10' are communicated and loaded to the system control program or software U3, the system control program or software U3 can alter various settings and parameters of the amusement device 12 to customize what is displayed on the touchscreen 12*a* in accordance with the style of the installed overlay 10'. Preferably, the system control program U3 is automatically triggered to display on the video display screen 12*a* the colors and content associated with the operatively connected overlay 10'. Such content includes, but is not limited to, videos, games, advertisements, songs, and the like.

Once the overlay 10' is secured to the housing 21 and in communication with the amusement device 12, the controller U4 of the overlay 10' is also preferably triggered by the system control program U3 to power up the lights of the overlay 10', such that the overlay 10' automatically presents the colors and/or patterns of light specified by the predetermined identifier or identifiers of that particular overlay 10'. In another embodiment, in addition to the system control program U3 altering the content on the video display screen 12*a* based on the predetermined identifier or identifiers of the overlay 10', the system control program U3 may alter and control the operating mode of the overlay 10' by sending instructions to the overlay 10' using the operative connection. Alternatively, the installer may manually prompt the system control program U3 to alter the operating mode of the overlay 10'.

Accordingly, an owner/operator of an amusement device need not reprogram the overlay 10' or amusement device 12, and particularly the light pattern, light color and/or content to be displayed on the display screen 12*a*, each time a new overlay 10' is attached to the housing 21 of the amusement device 12 and in communication with the amusement device 12. The present invention thus allows owners/operators to quickly and efficiently alter the appearance of their amusement devices 12 without having to reprogram or alter the individual settings of the overlay 10' or amusement device 12 to conform with the new appearance of the amusement device 12. However, some degree of reprogramming may alternatively be employed.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A nonportable amusement device comprising:

a display;

a memory;

a controller including a system control program and a communication port, the controller being electronically coupled to the memory and the display; and a removable overlay having one or more predetermined identifiers, one or more light sources, and a controller configured to control operation of the one or more light sources, the overlay being in communication with the communication port of the amusement device controller, the system control program being configured to:

(i) detect the one or more predetermined identifiers of the overlay, (ii) receive data associated with the one or more predetermined identifiers, (iii) modify and control the content and colors displayed by the display of the amusement device based on data associated with the one or more predetermined identifiers, and (iv) trigger the overlay controller to power up the light sources and cause the overlay to display a light pattern specified by the data associated with the one or more predetermined identifiers.

2. The nonportable amusement device of claim 1, wherein the overlay comprises one or more panels selectively attachable to and removable from a housing of the nonportable amusement device.

3. The nonportable amusement device of claim 2, wherein the one or more panels are backlit diffuser panels and are secured to a rigid frame.

4. The nonportable amusement device of claim 3, wherein the frame is fabricated of a sheet metal and the diffuser panels comprise one or more polymeric materials selected from the group consisting of acrylic, acrylonitrile butadiene styrene, polycarbonate and polyethylene terephthalate glycol.

5. The nonportable amusement device of claim 1, wherein the overlay has one or more selectively modifiable visual characteristics, the one or more visual characteristics being selected from the group consisting of images, graphics, colors, lighting, text, style and design.

6. The nonportable amusement device of claim 5, wherein one or more of the visual characteristics of the overlay are controlled by the one or more light sources.

7. The nonportable amusement device of claim 2, wherein the one or more panels are made of a wood material.

8. The nonportable amusement device of claim 2, wherein the one or more panels are flexible panels.

9. The nonportable amusement device of claim 2, wherein select portions of the overlay are interchangeable.

10. The nonportable amusement device of claim 1, wherein the nonportable amusement device is mounted or anchored to a wall, floor, table-top, counter-top or pole.

11. The nonportable amusement device of claim 1, wherein the one or more predetermined identifiers is one of a color, pattern, advertisement, video, and song.

12. The nonportable amusement device of claim 1, wherein the overlay is connected to a serial input/output interface in the amusement device.

13. The nonportable amusement device of claim 1, wherein the overlay controller includes a communication circuit which enables serial communication between the overlay and the amusement device.

14. The nonportable amusement device of claim 1, wherein the overlay is attached to the housing of the amusement device by one or more securing mechanisms selected from the group consisting of hook and latch assemblies, hook and loop fasteners, snaps, and adhesives.

15. The nonportable amusement device of claim 14, wherein lateral sides of the overlay include one or more catches configured to engage with one or more corresponding latches provided on lateral sides of the housing of the amusement device.

16. The nonportable amusement device of claim 15, wherein an upper end of the overlay includes one or more protrusions configured to engage with one or more corresponding recesses formed in an upper end of the housing of the amusement device.

17. The nonportable amusement device of claim 1, further comprising a hinged front access door, wherein the overlay moves together with the front access door when attached to the housing of the amusement device.

18. A nonportable amusement device comprising:

a display;

a memory;

an amusement device controller including a system control program and a communication port, the controller being electronically coupled to the memory and the display;

a first removable overlay having a first predetermined identifier, a first light pattern, and a first controller configured to control the first light pattern;

a second removable overlay having a second predetermined identifier, a second light pattern, and a second controller configured to control the second light pattern, the first predetermined identifier being different than the second predetermined identifier and the first light pattern being different than the second light pattern, the system control program being configured to:

(i) when the first removable overlay is mounted on the nonportable amusement device and the first controller is in communication with the amusement device controller, detect the first removable overlay, receive data associated with the first predetermined identifier, modify and control content displayed by the display of the amusement device based on data associated with the first predetermined identifier, and trigger the first controller to illuminate the first light pattern specified by the data associated with the first predetermined identifier, and (ii) when the second removable overlay is mounted on the nonportable amusement device and the second controller is in communication with the amusement device controller, detect the second removable overlay, receive data associated with the second predetermined identifier, modify and control the content displayed by the display of the amusement device based on data associated with the second predetermined identifier, and trigger the second controller to illuminate the second light pattern specified by the data associated with the second predetermined identifier.

* * * * *